US005368979A

United States Patent [19]

Freedman et al.

[11] Patent Number: 5,368,979

[45] Date of Patent: Nov. 29, 1994

[54] THERMALLY DEVELOPABLE PHOTOSENSITIVE ELEMENT

[75] Inventors: James R. Freedman, Newton Centre; David P. Waller, Lexington, both of Mass.

[73] Assignee: Polaroid Corporation, Cambridge, Mass.

[21] Appl. No.: 187,222

[22] Filed: Jan. 27, 1994

[51] Int. Cl.[5] ..... G03C 1/498

[52] U.S. Cl. ..... 430/203; 430/619

[58] Field of Search ..... 430/619, 203, 202, 211, 430/617

[56] References Cited

U.S. PATENT DOCUMENTS 3,719,489 3/1973 Cieciuch et al. ..... 96/29

4,098,783 7/1978 Cieciuch et al. ..... 260/147

4,452,883 6/1984 Frenchik et al. ..... 430/502

4,483,914 11/1984 Naito et al. ..... 430/203

FOREIGN PATENT DOCUMENTS 58-55692 3/1983 Japan .

*Primary Examiner*—Thorl Chea

*Attorney, Agent, or Firm*—Gaetano D. Maccarone

[57] ABSTRACT

There are described heat-developable photosensitive image-recording elements which include a photosensitive silver halide emulsion, a silver salt and an image dye-providing material. The silver salt material is provided in a layer which is separated from the layer including the image dye-providing material by a layer containing the silver halide emulsion.

12 Claims, No Drawings

THERMALLY DEVELOPABLE PHOTOSENSITIVE ELEMENT

BACKGROUND OF THE INVENTION

The present invention relates to a heat-developable photosensitive element and, more particularly, to an element capable of providing images having good image discrimination, enhanced image density and accelerated silver development.

It is well known that various cleavage reactions are assisted by silver ions including reactions involving cleavage of a compound into one or more fragments. U.S. Pat. No. 3,719,489 discloses silver ion assisted cleavage reactions useful in photographic systems. As disclosed therein, photographically inert compounds are capable of undergoing cleavage in the presence of silver ions made available imagewise during processing of a silver halide emulsion to liberate a reagent, such as a photographically active reagent or a dye in an imagewise distribution corresponding to that of said silver ions. In one embodiment disclosed therein, color images are produced by using as the photographically inert compounds, color providing compounds which are substantially non-diffusible in the photographic processing composition but capable of undergoing cleavage in the presence of the imagewise distribution of silver ions and/or soluble silver complex made available in the undeveloped and partially developed areas of a silver halide emulsion as a function of development to liberate a more mobile and diffusible color-providing moiety in an imagewise distribution corresponding to the imagewise distribution of said ions and/or said complex. The subsequent formation of a color image is the result of the differential in diffusibility between the parent compound and liberated color-providing moiety whereby the imagewise distribution of the more diffusible color-providing moiety released in the undeveloped and partially developed areas is free to transfer.

Color-providing compounds useful in the above process form the subject matter of U.S. Pat. No. 4,098,783, a continuation in part of said U.S. Pat. No. 3,719,489. The color-providing compounds disclosed therein may comprise one or more dye radicals and one or more 1,3-sulfur-nitrogen moieties. For example, they may comprise one complete dye or dye intermediate and one cyclic 1,3-sulfur-nitrogen moiety. Alternatively, the color-providing compounds may comprise two or more cyclic moieties for each dye radical or dye intermediate or vice versa.

Heat-developable photosensitive imaging materials are well known in the art, including thermally developable black and white as well as color photosensitive materials. Further, it is known in the art that such imaging materials may include various image dye-providing materials to provide the desired image. For example, Japanese Kokai 59-180548 having a Laid-Open date of Oct. 13, 1984 discloses a heat-developable silver halide photosensitive imaging system wherein the dye-providing material contains a heterocyclic ring containing a nitrogen atom and a sulfur or selenium atom which heterocyclic ring is subject to cleavage in the presence of silver ions to release a diffusible dye. An example of a suitable dye-providing material is a thiazolidine dye such as disclosed in U.S. Pat. No. 4,098,783. The process involves imagewise exposing the photosensitive system to light and subsequently or simultaneously heating the photosensitive system, in the presence of a base or base precursor, under a substantially water-free condition whereby an oxidation-reduction reaction between the exposed photosensitive silver halide and a reducing agent occurs. In the exposed areas, a negative silver image is formed. In the unexposed areas, the silver ion, present in inverse proportion to the silver image, causes the heterocyclic ring of the dye-providing material to be cleaved, releasing a diffusible dye. The diffusible dye is then transferred to an image-receiving layer, whereby a positive dye image is formed.

Generally speaking, a heat developable photosensitive system useful in terms of thermal development of the silver halide latent image is one which comprises a support carrying photosensitive silver halide, a silver salt oxidizer, a thermal solvent, a reducing agent for the silver salt, a binder and an image dye-providing material. Prior art disclosures teach the desirability of having the silver salt and the silver halide in the same layer within the photothermographic element. U.S. Pat. No. 4,452,883 teaches that the photographic silver halide material must be in catalytic proximity to the light insensitive silver source (the silver salt) and refers to catalytic proximity in terms of intimate physical association of these materials. U.S. Pat. No. 4,483,914 discloses that the silver halide and the silver salt oxidizing agent which form the starting point for development should be present within a substantially effective distance of one another and for this purpose should be present within the same layer.

However, difficulties have been encountered with such heat-developable photosensitive systems wherein image discrimination is based on soluble silver ions and/or soluble silver complex because of prerelease of dye from mobile silver during coating or during photothermal processing before silver development takes place. Such prerelease of dye is a major contributor to higher-than-desired Dmin values.

As the state of the art advances, novel approaches continue to be sought in order to attain the required performance criteria for these systems. The present invention relates to a photothermographic image-recording element.

SUMMARY OF THE INVENTION

There is provided according to the invention a heat-developable photosensitive image-recording element wherein the mobile organic silver salt is separated from the light-sensitive silver halide material. In the image-recording elements of the invention the mobile organic silver salt is provided in a layer which is separated from the image dye-providing material layer by a silver halide emulsion layer. Thus, during photothermal processing, the mobile silver salt has to diffuse through silver halide before reaching the image dye-providing material to initiate diffusion of a mobile image dye material.

Photothermographic elements according to the invention have been found to provide good silver development and image dye densities in the resulting photographs which also exhibit decreased background areas, i.e. Dmin values.

These and other objects and advantages which are provided in accordance with the invention will in part be obvious and in part be described hereinafter in conjunction with the detailed description of various preferred embodiments of the invention. The invention accordingly comprises the processes involving the several steps and relation and order of one or more of such steps with respect to each of the others, and the product and compositions possessing the features, properties and relation of elements which are exemplified in the following detailed disclosure, and the scope of the application of which will be indicated in the claims.

DESCRIPTION OF THE PREFERRED EMBODIMENTS

The chemical imaging system which is utilized in the photothermographic image-recording elements of the invention may be any in which the image discrimination is based on soluble silver ions and/or soluble silver complex. The chemical imaging system provides an imagewise distribution of image dye-providing material as a result of an imagewise distribution of silver ions and/or soluble silver complex. In a preferred embodiment, the image dye-providing material is substantially non-diffusible in the heat-developable photographic processing composition but capable of providing a mobile and diffusible image dye material in the presence of the imagewise distribution of silver ions and/or soluble silver complex made available in the undeveloped and partially developed areas of the photosensitive emulsion as a function of development in an imagewise distribution corresponding to the imagewise distribution of silver ions and/or soluble silver complex.

Typically, the chemical imaging system incorporated in the image-recording element of the invention is a competitive, or parallel, imaging system. By a "competitive (or parallel) chemical imaging system" is meant an imaging system wherein a single species such as a silver salt or a reducing agent takes part in two or more reactions which occur simultaneously during the imaging process. Hence there are two or more parallel reaction paths existing (or competing) at the same time for the single chemical species. These competing reactions provide an imagewise distribution of the single species which results in image discrimination. A specific example is where a single chemical species takes part in both the development reaction of silver halide or soluble silver ion or soluble silver ion-containing species and in the reaction that controls the formation or transfer of the image dye. An example of a parallel reaction imaging system and the species involved in both reactions are $Ag^+$ catalyzed dye release reactions as described in U.S. Pat. Nos. 3,719,488, 3,719,489, 4,060,417, 4,098,783 and U.K. Pat. Appl. 1243 046. $Ag^+$ is involved in both development and dye release reactions occurring simultaneously. $Ag^+$ is involved in the dye release reaction or consumed by the development reaction with exposed silver halide. Another example is $Ag^+$ complexation and immobilization of dyes as described in U.S. Pat. No. 3,443,941. $Ag^+$ is either developed or complexes with dye molecules to yield a negative image. $Ag^+$ complexes with and immobilizes dyes or is consumed by reaction with exposed silver halide.

A preferred class of image dye-providing materials is comprised of those which are capable of undergoing cleavage in the presence of the imagewise distribution of silver ions and/or soluble silver complex made available in the undeveloped and partially developed areas of the photosensitive emulsion as a function of development to liberate a more mobile and diffusible image dye-providing moiety in an imagewise distribution corresponding to the imagewise distribution of said ions and/or said complex. Suitable image dye-providing materials of this type include those containing at least one heterocyclic ring having a 1,3 sulfur-nitrogen moiety and at least one dye radical, which heterocyclic ring is subject to a cleavage reaction in the presence of silver ions and/or a soluble silver complex to release a diffusible dye. Typical suitable image dye-providing materials of this type are disclosed in U.S. Pat. No. 4,098,783 and in copending, commonly-assigned patent applications, Ser. No. 07/923,843, filed Jul. 31, 1992 and Ser. No. 07/994,897, filed Dec. 28, 1992. Preferred image dye-providing materials include the thiazolidine image dye-providing materials described in U.S. Pat. 4,098,783 and those described in copending application Ser. No. 08/058,494, filed May 6, 1993. The image dye-providing materials may be prepared by techniques known to those skilled in the art and by those disclosed in the previously-mentioned United States patent and patent applications.

As described previously, the image dye-providing material is incorporated in a layer which is separate from the layer in which the photosensitive silver halide is located and also separate from the layer in which the silver salt is located. However, it is generally preferred that the image dye-providing materials be located such that exposure does not occur through the dye. If exposure is made through the dye, the dye may absorb some of the light needed to expose the silver halide. In certain instances, it may be desirable to separate the image dye-providing material from the photosensitive silver halide layer by a spacer layer. Where the particular image dye-providing material chosen tends to be migratory during storage and/or thermal development of the photosensitive system, it is preferred that the image dye-providing material be in a separate layer and particularly preferably, that it be in the layer farthest from the image-receiving layer.

The amount of image dye-providing material used varies with the type chosen but generally an amount of from about 0.25 to about 2.0 mmol/$m^2$ is used.

The image dye-providing materials may be incorporated into the photographic layer(s) of the heat-developable photosensitive system by any suitable method. For example, the image dye-providing materials can be dissolved in a low boiling and/or high boiling solvent and dispersed in the binder, they can be dispersed in aqueous solutions of suitable polymers, e.g., gelatin, by means of a ball mill, or they can be solvent coated using any organic solvent that will also dissolve the binder, e.g., trifluoroethanol or dimethylsulfoxide (DMSO).

Heat developable photosensitive systems which are useful in the thermal development of a silver halide latent image typically comprise a support carrying photosensitive silver halide, a silver salt oxidizer, a thermal solvent, a reducing agent for the silver salt, a binder which is preferably gelatin and an image dye-providing material.

The support for the image-recording elements according to the present invention can be transparent or opaque and must necessarily be able to withstand the heat required for processing the image. Any suitable support can be employed such as those described in Research Disclosure No. 17029, issued June 1978. Specific examples of suitable supports include synthetic polymeric films, such as polyethylene terephthalate, polycarbonate, polyvinyl chloride, polystyrene, polyethylene, polypropylene and polyimide. The above described supports can be made opaque by incorporating pigments therein such as titanium dioxide and calcium carbonate. Other supports include paper supports, such as photographic raw paper, printing paper, baryta paper and resin-coated paper having paper laminated with pigmented thermoplastic resins, fabrics, glass and metals.

A subcoat may be added to the face of the support which carries the heat-developable photosensitive materials in order to increase adhesion. For example, a polyester base coated with a gelatin subcoat has been found to enhance adhesion of aqueous based layers.

Thermal solvents which are useful in photothermographic imaging elements and methods are nonhydrolyzable, thermally stable compounds which are solids at ambient temperatures but which melt at or below the temperature used in photothermographic processing. The thermal solvent acts as a solvent for various components of the heat developable photosensitive material, assists in the acceleration of thermal development and provides the medium for diffusion of various components including silver ions and/or silver complexes, reducing agents and image dye materials. Many suitable thermal solvents for use in photothermographic imaging elements are known in the art. Any suitable thermal solvent may be incorporated in the image-recording elements of the invention.

It is known that suitable binders for photosensitive silver halide emulsion layers include water soluble synthetic, high molecular weight compounds such as polyvinyl alcohol and polyvinylpyrrolidone and synthetic or naturally occurring high molecular weight compounds such as gelatin, gelatin derivatives, cellulose derivatives, proteins, starches and gum arabic. A preferred binder material is gelatin.

Typical suitable thermal solvents, preferably for use with gelatin, include:

- polyols, such as sorbitol, erythritol, cyclohexane-1,3-diol, cyclohexane-1,4-diol, ethylene glycol, low MW (MW<300) polyethylethene glycol, etc.;
- amides of the general formula $CH_3C(O)NR_1R_2$ wherein $R_1$ and $R_2$ can be, for example, H, $CH_3$, $C(O)CH_3$, $C_5H_5N$, $CH_2OH$, $CH_2CH_2OH$; cyclic amides such as succinamide and succinamides substituted by $CH_3$, OH, $C(O)CH_3$, $C_5H_5N$, $CH_2OH$ or $CH_2CH_2OH$;
- sulfonamides of the general formula $CH_3SO_2NR_3R_4$ wherein $R_3$ and $R_4$ can be H, $CH_3$, $C(O)CH_3$, $C_5H_5N$, $CH_2OH$ or $CH_2CH_2OH$; cyclic sulfonamides such as propylene sulfonamide and propylene sulfonamide substituted by $CH_3$, OH, $C(O)CH_3$, $CH_2OH$ or $CH_2CH_2OH$;
- ureas or thioureas of the general formula $R_5R_6NC(O)NR_7R_8$ or $R_5R_6NC(S)NR_7R_8$ where $R_5$, $R_6$, $R_7$, $R_8$ can be H, Me, Et, $CH_2OH$, $CH_2CH_2OH$ or $CH_3C(O)$, or $R_5$ and $R_7$ can be $C_3H_7$, $C_4H_9$, $C_6H_5$, when $R_6$ and $R_8$ are H; cyclic ureas and thioureas such as propylene urea or propylene thiourea substituted by H, OH, $CH_3$, $CH_2OH$, $C(O)CH_3$ or $CH_2CH_2OH$;
- sulfoxides of the general formula $$R_9\overset{\overset{\displaystyle O}{\|}}{S}R_{10}$$

where $R_9$ and $R_{10}$ can be $C_6H_5$, $C_6H_4R_{11}$ or $C_5H_5N$ where $R_{11}$ can be H, $CH_3$, OH, $NH_2$, $CH_2OH$, $OCH_3$ or a halogen;

Compounds of the general formula:

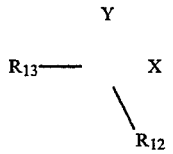

where X and Y are C or N and are connected by sufficient atoms to complete a 5- or 6-membered aromatic ring, with at least one of the atoms in the ring being C;

$R_{12}$ can be $CH_2C(O)NR_3R_4$, $C(O)NR_{14}R_{15}$, $SO_2NR_{14}R_{15}$, $NR_{14}C(O)R_{15}$, $NR_{14}C(O)OR_{15}$ or $NR_3C(O)NR_4$;

$R_{13}$ can be H, halogen, $CH_3$, OH, $OCH_3$, $(OCH_2CH_2)nOH$, $(OCH_2CH_2)OCH_3$, $CH_2C(O)NR_{14}R_{15}$, $C(O)NR_{14}R_{15}$, $SO_2NR_{14}R_{15}$, $NR_{14}C(O)R_{15}$ or $NR_{14}C(O)OR_{15}$;

$R_{14}$and $R_{15}$ can be H, Me, $C_5H_5N$, $CH_2OH$, $CH_2CH_2OH$, $C(O)CH_3$, $NH_2$, $NHCH_3$, $NMe_2$ or $C_6H_5$, $C_6H_4R_{16}$;

$R_{16}$ can be H, Me, OH, $NH_2$ or $CH_2OH$; and n is 1, 2, or 3.

Another class of thermal solvents for gelatin is made up of nicotinamide and nicotinamide derivatives. Various preferred thermal solvents for gelatin and some of their properties are listed below.

Properties of Thermal Solvents

| Compound | Melting Point (°C.) | Water Solubility at 40° C. |
|---|---|---|
| nicotinamide | 130–33 | >1% |
| N-methyl-nicotinamide | 102–05 | >1% |
| N,N-dimethylnicotinamide | 43–45 | >2% |
| 4-chloronicotinamide | 110 | >1% |
| N-(3-toloyl)nicotinamide | 81–86 | >1% |
| N-(4-tolyl)nicotinamide | 146–149 | <1% |
| 6-Me-N-Me-nicotinamide | 133–34 | >1% |
| picolinamide | 107–09 | >2.5% |
| isonicotinamide | 155–57 | >1% |
| N-(2-hydroxyethyl)-isonicotinamide | 136–38 | >1% |
| N,N-bis-(2-hydroxyethyl)-isonicotinamide | 132–33 | >>1% |
| (3-pyridyl)sulfonamide | 107–10 | >5% |
| N-Me-4-Cl-3-pyridylsulfonamide | 185–88 | <0.25% |
| N-Me-6-Cl-3-pyridylsulfonamide | 109–11 | 0.5<x<1% |
| N-Me-3-pyridylsulfonamide | 112–15 | >2% |
| N,N-di-Methyl-3-pyridinesulfonamide | 95–98 | ~1% |
| N-acetyl-p-tolylsulfonamide | 137–40 | 0.25<x<0.5% |
| p-tolylsulfonamide | 138–39 | ~0.5% |
| N-acetyl-methylsulfonamide | 99–101 | >2% |
| N,N'-dimethyl-benzoylhydrazine | 105–7 | >2% |
| N-(2-pyridolymethyl)-3-amino-pyridine | 105–7 | ~1% |
| o-toluamide | 141–42 | <1% |
| p-toluamide | 161–63 | <1% |
| m-tolumaide | 94–96 | <1% |
| 3-fluorobenzamide | 129–32 | <1% |
| 1,4-cyclohexane-diol | 98–100 | >1% |
| 1,3-cyclohexane-diol | liquid | >1% |
| 1-(3-pyridyl)-acetamide | 113–115 | >2% |
| 1-(2-pyridyl)-acetamide | 119–20 | >2% |
| urea | 133–135 | >1% |
| tetramethylthiourea | 75–77 | <1% |
| N,N'-dibutylthiourea | 63–65 | <1% |
| N-Methyl-N'-(3-pyridyl)- | 142–45 | >2% |

-continued

| Compound | Properties of Thermal Solvents: Melting Point (°C.) | Water Solubility at 40° C. |
|---|---|---|
| urea | | |
| Methyl N-(3-pyridyl)carbamate | 121–23 | <0.5% |
| erythritol | 120–23 | >10% |
| sorbitol | 98–100 | >10% |
| 1,2,4-triazole | 119–21 | >10% |
| acetamide | 70 | >1% |
| di-p-tolylsulfoxide | 94–96 | <0.25% |
| 3,4-dimethyl benzamide | 101–02 | <1% |
| (4-methylphenyl)urea | 143–44 | <0.5% |

Listed below are various thermal solvents for other suitable binders. These thermal solvents are also suitable thermal solvents for use with gelatin as shown above.

| Binder | Thermal Solvent |
|---|---|
| polyvinylpyrrolidone (MW avg. 360,000) | m-toluamide |
| polyvinylpyrrolidone (MW avg. 360,000) | M-methylnicotinamide |
| polyvinylpyrrolidone (MW avg. 360,000) | p-tolylsulfoxide |
| polyvinylalcohol (MV avg. 86,000) | m-toluamide |
| polyvinylalcohol (MV avg. 86,000) | N-methylnicotinamide |
| polyvinylalcohol (MV avg. 86,000) | sorbitol |

It is preferred that the thermal solvents which are utilized in the image-recording materials of the invention have low solubility in water, e.g., less than 1%. These thermal solvents are advantageous because of coatability considerations since the layers of the image-recording materials are typically coated from water dispersions. In addition, image-recording materials having such thermal solvents typically exhibit enhanced stability during storage.

A single thermal solvent can be incorporated in a layer of the image-recording material or a combination of two or more thermal solvents may be incorporated in a layer. In another embodiment, different thermal solvents may be used separately in different layers of the image-recording elements. In this case, it would be apparent to those skilled in the art that the choice of such thermal solvents should be made such that their use together in the image-recording material would not have any adverse effect upon the image formation process.

Generally, the image-recording materials of the invention should have a sufficient amount of thermal solvent to provide a medium for reaction and diffusion which will allow the required imagewise distribution of image dye-providing material to occur. The thermal solvent can be present in one or more layers of the image-recording material; it is preferred to have thermal solvent in each layer. Further, while the thermal solvent may be present in only the photosensitive element, or donor sheet, or only the image-receiving element, thermal solvent may be present in each of the photosensitive and image-receiving elements. The total amount of thermal solvent in the image-recording material should be sufficient to dissolve substantially all the binder material which is present. The amount of thermal solvent present in a single layer is typically from 0 to about 10 g/m$^2$ and preferably from about 0.1 to about 1.5 g/m$^2$.

It will be understood by those skilled in the art that the heat-developable photosensitive image-recording element of the invention can be processed and the image dye transferred in the absence of a base or base precursor, if required. Base precursors are materials which generated a base under the processing conditions utilized.

The photosensitive silver halide used in the photothermographic elements of the present invention may be any photosensitive silver halide employed in the photographic art, such as silver chloride, iodide, bromide, iodobromide, chlorobromide, etc., and it may be prepared in situ or ex situ by any known method including using a light-sensitive silver halide-forming component in the presence of the silver salt oxidizing material so as to form the light sensitive silver halide in part of the silver salt oxidizer.

The photosensitive silver halide emulsions are typically aqueous silver halide emulsions, and any conventional silver halide precipitation methods may be employed in the preparation of the emulsions. The silver halide emulsions may be spectrally sensitized by any suitable spectral sensitization method in order to extend the photographic sensitivity to wavelengths other than those absorbed by the unsensitized silver halide. Examples of suitable sensitizing materials include cyanine dyes, merocyanine dyes, styryl dyes, hemicyanine dyes and oxonole dyes. In addition to spectral sensitization, the silver halide emulsions may be chemically sensitized using any suitable chemical sensitization technique. Many chemical sensitization methods are known in the art.

The silver halide emulsion is generally added to each photosensitive layer in an amount calculated to give a coated coverage in the range of 0.5 to 8.0 mmol/m$^2$, preferably 0.5 to 4.0 mmol/m$^2$.

The silver salt oxidizing material should be relatively light stable and thermally stable under the processing conditions. The silver salt oxidizing material is generally an organic silver salt or silver salt complex as is known in the art. Any suitable organic compound which is useful for forming the organic silver salt may be employed. See, e.g., the organic silver salts described in U.S. Pat. No. 4,729,942. See U.S. Pat. No. 4,260,677 for useful silver salt complexes.

Examples of suitable silver salt oxidizing materials include silver salts of carboxylic acids, e.g., behenic and stearic acids and silver salts of compounds having an imino group. Preferred silver salts are the organic silver salts having an imino group. The silver salts of benzotriazole and its derivatives have been found to give particularly good results in the heat-developable photosensitive systems of the present invention.

The silver salt oxidizer used in the present invention can be prepared in a suitable binder by any known means and then used immediately without being isolated. Alternatively, the silver salt oxidizer may be isolated and then dispersed in a suitable binder. The silver salt oxidizer is generally used in an amount ranging from about 0.5 to about 12.0 mmol/m$^2$, and preferably from about 0.5 to about 4.0 mmol/m$^2$.

Any suitable reducing agents may be used in the photothermographic image-recording elements of the present invention, and these may be selected from among those commonly used in heat-developable photographic materials. Illustrative reducing agents useful in the present invention include hydroquinone and its derivatives, e.g., 2-chlorohydroquinone; aminophenol derivatives, e.g., 4-aminophenol and 3,5-dibromophenol; catechol and its derivatives, e.g., 3-methoxycatechol; phenylenediamine derivatives, e.g., N,N-diethyl-p-phenylenediamine; and, 3-pyrazolidone derivatives, e.g., 1-phenyl-3-pyrazolidone and 4-hydroxymethyl-4-methyl-1-phenyl-3-pyrazolidone. The preferred reducing agents are 1-phenyl-3-pyrazolidone, commercially available under the tradename Phenidone, and 4-hydroxymethyl-4-methyl-1-phenyl-3-pyrazolidone, commercially available under the tradename Dimezone-S.

The reducing agents may be used singly or in combination and are generally employed in amounts ranging from about 0.5 to about 10.0 mmol/$m^2$, and preferably from about 1.0 to about 8.0 mmol/$m^2$.

The photosensitive silver halide emulsion layer(s) and other layers of the heat-developable photosensitive image-recording material may contain various materials as binders. Suitable binders include water soluble synthetic high-molecular weight compounds such as polyvinyl alcohol and polyvinylpyrrolidone, and synthetic or natural high-molecular weight compounds such as gelatin, gelatin derivatives, cellulose derivatives, proteins, starches and gum arabic. A single binder or mixture of binders may be used. Gelatin is the preferred binder for use in each layer. The amount of binder used in each layer is generally from about 0.5 to about 5.0 g/$m^2$, preferably from about 0.5 to about 3.0 g/$m^2$.

The layers of the heat-developable photosensitive system according to the present invention which contain a crosslinkable colloid as a binder, e.g., gelatin, can be hardened by using various organic and inorganic hardeners such as those described in T. H. James, *The Theory of the Photographic Process*, 4th Ed., MacMillan, 1977, pp. 77–87. The hardeners can be used alone or in combination. It is preferred that the image-recording elements according to the present invention contain a hardener in the photosensitive silver halide emulsion layer(s). Any suitable hardener may be used; however, aldehyde hardeners, e.g., succinaldehyde and glyoxal, have been found to be particularly useful when gelatin is employed as the binder. The hardeners are generally used in amounts ranging from 1 to 10% by weight of the total amount of gelatin coated.

The heat-developable photosensitive image-recording elements of the present invention can be used to form monochrome or multicolor images. If the image-recording element is to be used to generate a full color-image, it generally has three different heat-developable light-sensitive layers each releasing a different color dye as a result of thermal development.

Where multicolor images are desired, one or more layers containing a scavenger for silver ion and/or soluble silver complex may be employed between the photosensitive emulsion layers to enhance color separation. By virtue of the silver scavenger layer(s) positioned between the emulsion layers, the migration of the imagewise distribution of soluble silver ions or soluble silver complex formed during processing of each emulsion layer is confined to the dye-providing material associated with each emulsion layer and prevented from diffusing into the dye-providing material associated with the other emulsion layer or layers. Silver scavengers which may be employed in the present invention include those described in U.S. Pat. No. 4,060,417.

The heat-developable photosensitive image-recording elements of the present invention include those wherein the photosensitive silver halide emulsion layer(s) and the image-receiving layer are initially contained in separate elements which are brought into superposition subsequent or prior to exposure. After development the two layers may be retained together in a single element, i.e., an integral negative-positive film unit or they can be peeled apart from one another. Alternatively, rather than being in separate elements, the photosensitive layer(s) and the image-receiving layer may initially be in a single element wherein the negative and positive components are contained in a heat-developable photosensitive laminate or otherwise retained together in an integral structure. After heat-development, the two layers may be retained together as a single element or they can be peeled apart from one another. Where the photosensitive silver halide emulsion layer(s) and the image-receiving layer are retained together as an integral negative-positive film unit, a masking layer, e.g., titanium dioxide, may be necessary to conceal the untransferred dye-providing material and other products from photothermographic development from the final image.

Where the image-recording elements of the invention comprise separate elements which are brought together prior, or subsequent, to exposure, it is preferred that the image dye-providing material be located in a layer which underlies the silver halide emulsion layer which in turn underlies the organic silver salt layer. In this embodiment, it is preferred to expose the photosensitive layer through the outermost layer, so that the exposure is not made through the image dye-providing material, prior to superposing the two separate elements in order to carry out the remaining steps of the photothermographic processing. Similarly, where all the layers of the heat developable, image-recording element are carried by one support, it is preferred to arrange the image-receiving layer adjacent the support and underlying, in succession, the image dye-providing material layer, the silver halide emulsion layer and the organic silver salt layer. Exposure is preferably made through the outermost layer.

The photosensitive element of the present invention may be exposed by any of the methods used in the photographic art, e.g., a tungsten lamp, a mercury vapor lamp, a halogen lamp, fluorescent light, a xenon flash lamp or a light emitting diode including those which emit infrared radiation.

The photosensitive image-recording elements of the present invention are heat-developed after imagewise exposure. This is generally accomplished by heating the element at a temperature in the range of from about 80° to about 200° C., preferably in the range of from about 100° to about 150° C., for a period of from about 1 to about 720 seconds, preferably from about 1.5 to about 360 seconds. Heat may be used alone or heat may be applied simultaneously with pressure, if necessary, to create good thermal contact between the photosensitive and image-receiving elements. Pressure can be applied simultaneously with the heat required for thermal development by using heated rollers or heated plates. Alternatively, heat and, if required, pressure can be applied subsequent to thermal development in order to transfer the released dye.

Any method of heating that can be employed in heat-developable photosensitive systems may be applied to the heat-developable photographic element of the present invention. Thus, for example, heating may be accomplished by using hot air, a hot plate, an iron, heated rollers or a hot drum.

Any image-receiving layer which has the capability of receiving the dye released as a result of thermal development may be utilized in the image-recording elements of the invention. Typical image-receiving layers which can be used are prepared by coating a support material with a suitable polymer for receiving the dye. Alternatively, certain polymers may be used as both the support and the dye receiving material.

The image-receiving layer is generally superposed on the photosensitive negative after exposure and the two are then heated simultaneously to develop the image and cause the dye to transfer. Alternatively, the negative may be exposed and then processed with heat, followed by superposing the image-receiving sheet on the exposed and developed photosensitive material and applying heat and pressure to transfer the dye. The image-receiving layer is then generally peeled apart from the negative.

Suitable polymers to be coated on the image-receiving support to receive dye include polyvinyl chloride, poly(methyl methacrylate), polyesters, and polycarbonates.

Additionally, the heat-developable photosensitive image-recording material of the present invention optionally may include other materials known in the art for use in photothermographic image-recording elements. These include, but are not limited to, antifoggants, antistatic materials, coating aids e.g., surfactants, activators and the like.

Also, the photosensitive elements optionally may contain additional layers commonly used in the art, such as spacer layers, a layer of an antihalation dye, and/or a layer of a filter dye arranged between differentially color-sensitive emulsion layers. A protective layer may also be present in the image-recording material of the present invention. The protective layer may contain a variety of additives commonly employed in the photographic art. Suitable additives include matting agents, colloidal silica, slip agents, organofluoro compounds, UV absorbers, accelerators, antioxidants, etc.

The invention will now be described further in detail with respect to specific preferred embodiments by way of examples, it being understood that these are intended to be illustrative only, and the invention is not limited to the materials, procedures, amounts, etc. recited therein. All parts and percentages recited are by weight unless otherwise stated.

EXAMPLES

In the following examples, the silver iodobromide dispersion is a 0.25 μm cubic unsensitized iodobromide (2% iodide) emulsion prepared by standard techniques known in the art. The silver salt oxidizer, thermal solvent, dye-providing material and reducing agents used in the Examples were added to the coating compositions as dispersions. The various dispersions were prepared by the specific procedures described below or by analogous procedures but using different reagents as noted. If an aqueous dispersion was employed, it was prepared by an analogous procedure to that described below for the thermal solvent. The other components of the layers, e.g., succinaldehyde and Zonyl-FSN were added to the coating compositions as aqueous solutions.

(1) Silver Salt Dispersion

Benzotriazole (415 g) was added to 325 mL of concentrated ammonium hydroxide. To the resulting solution was added 450 g of gelatin and the mixture was diluted to a total volume of 6 liters with water. To this mixture, in the dark and at 40° C., was added with stirring, over a one-hour period, a mixture prepared by combining 550 g of silver nitrate with 500 mL of concentrated ammonium hydroxide and diluted to a total volume of 2.1 liters with water. The mixture stood at room temperature for about 60 minutes and then the material was washed using standard emulsion washing procedures and the pH adjusted to 6 and the pAg adjusted to 7.4.

(2) Thermal Solvent Dispersion

The thermal solvent was dispersed in a mixture of 10% aqueous polyvinylpyrrolidone, 5% aqueous Alkanol XC (available from du Pont, Wilmington, Del.) and water. The resulting mixture was ground in a ball mill for 7 hours. Water was introduced for washing purposes during the isolation of the dispersion.

3. Dispersion of Image Dye-Providing Material 1.6 g of dye-providing material, Compound A, having the structure Compound A

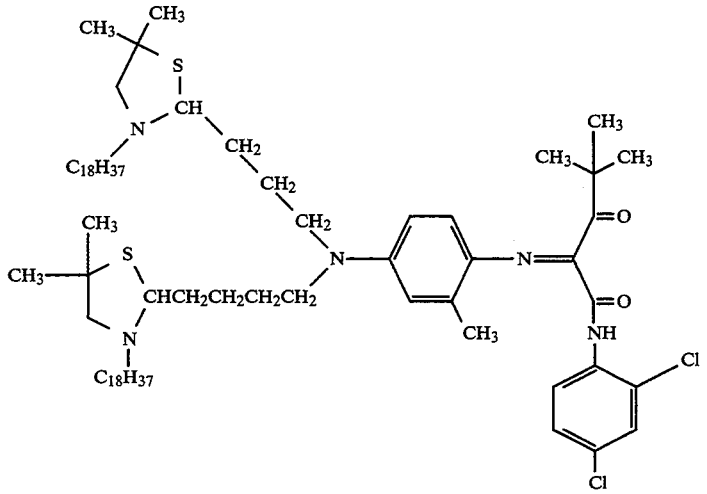

was dissolved in 5.0 g of ethyl acetate. 0.8 g of tricresylphosphate was added and the mixture was stirred and heated to 42° C. To the mixture at 40° C. was added a solution containing 21 g water, 4 g of 5% aqueous Alkanol XC and 8.5 g of 17.5% aqueous gelatin. The mixture was sonified with an ultrasonic probe for one minute in order to form a dispersion. The dispersion was stirred at 60° C. for 20 minutes to remove the ethyl acetate, followed by the addition of 14.1 g water.

4. Reducing Agent Dispersion

Exactly 3.0 g of 4-hydroxymethyl-4-methyl-1-phenyl-3-pyrazolidinone (Dimezone S) were added to 4.0 g of water and 3.0 g of 5% aqueous Alkanol XC. The resulting mixture was ground in a ball mill for 16 hours. The resulting dispersion was diluted with water during isolation.

The following compounds were utilized in the Examples:

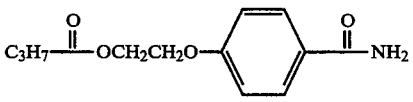

Compound B

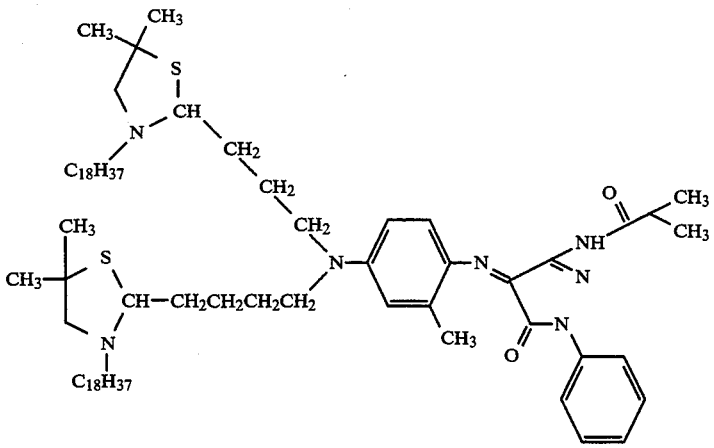

Compound C

EXAMPLE I

Control-1 heat-developable photosensitive image-recording elements were prepared wherein the photosensitive element comprised a gelatin-subcoated 4 mil polyester photographic film base having coated thereon in succession the following layers:

| | |
|---|---|
| **Layer 1** | |
| Gelatin (inert, deionized, derivatized bone gelatin available from Rousselot, France) | 750 mg/m$^2$ |
| m-toluamide | 500 mg/m$^2$ |
| Compound A | 0.75 mmol/m$^2$ |
| Glyoxal | 20 mg/m$^2$ |
| Zonyl FSN (perfluoroalkyl polyethylene oxide non-ionic surfactant available from E. I. du Pont) | 0.1% by wt. |
| **Layer 2** | |
| Gelatin | 750 mg/m$^2$ |
| m-toluamide | 500 mg/m$^2$ |
| Dimezone S | 8 mmol/m$^2$ |
| Glyoxal | 15 mg/m$^2$ |
| Zonyl FSN | 0.1% by wt. |
| **Layer 3** | |
| Gelatin | 750 mg/m$^2$ |
| m-toluamide | 500 mg/m$^2$ |
| Silver benzotriazole | 4 mmol/m$^2$ |
| Silver iodobromide | 2 mmol/m$^2$ |
| Glyoxal | 15 mg/m$^2$ |
| Zonyl FSN | 0.15% by wt. |
| Alkanol XC | 0.25% by wt. |

Heat-developable photosensitive image-recording elements (A) according to the invention were prepared wherein the photosensitive element comprised a gelatin subcoated 4 mil polyester photographic film base having coated thereon in succession the following layers:

| | |
|---|---|
| **Layer 1** | |
| Gelatin | 750 mg/m$^2$ |
| m-toluamide | 500 mg/m$^2$ |
| Compound A | 0.75 mmol/m$^2$ |
| Glyoxal | 20 mg/m$^2$ |
| Zonyl FSN | 0.1% by wt. |
| **Layer 2** | |
| Gelatin | 750 mg/m$^2$ |
| m-toluamide | 500 mg/m$^2$ |
| Silver iodobromide | 2 mmol/m$^2$ |
| Dimezone S | 8 mmol/m$^2$ |
| Glyoxal | 15 mg/m$^2$ |
| Zonyl FSN | 0.1% by wt. |
| **Layer 3** | |
| Gelatin | 750 mg/m$^2$ |
| m-toluamide | 500 mg/m$^2$ |
| Silver benzotriazole | 4 mmol/m$^2$ |
| Glyoxal | 15 mg/m$^2$ |
| Zonyl FSN | 0.15% by wt. |
| Alkanol XC | 0.25% by wt. |

Receiver elements (I) were prepared comprising baryta paper coated with an image-receiving layer of polyvinyl chloride coated at a coverage of 12 g/m$^2$.

Receiver elements (II) were prepared which were the same as receiver elements (I) with the exception that they further included, coated over the polyvinyl chloride layer, a layer comprising:

| | |
|---|---|
| Gelatin | 500 mg/m$^2$ |
| m-toluamide | 750 mg/m$^2$ |
| p-hydroxyphenylmercaptotetrazole | 1 mmol/m$^2$ |
| Glyoxal | 10 mg/m$^2$ |

Control-1 and image-recording elements A were prepared with receiver elements I and II, respectively. The photosensitive elements were exposed to a standard sensitometric target with white light for $10^{-3}$ sec, after which the receiver element was superposed on the exposed photosensitive element, and the heat developable photographic unit was processed for 180 seconds at 120° C. at a pressure of 35 psi using a heated plate.

The photosensitive element was peeled apart from the image-receiving element after they were allowed to cool significantly below the melting point of the thermal solvent (102° C.) which occurred approximately 5 sec after processing. The maximum reflection density (Dmax) and the minimum reflection density (Dmin) of the resulting image on the image-receiving member were measured with a reflection densitometer (MacBeth Model RD 514). The measured values are shown in Table I.

TABLE 1

| Image-Recording Element | Image-Receiving Element I Dmax | I Dmin | II Dmax | II Dmin |
|---|---|---|---|---|
| Control-1 | 0.50 | 0.45 | 1.45 | 0.55 |
| A | 1.20 | 0.37 | 1.95 | 0.35 |

It can be seen that the image-recording elements of the invention exhibited significantly improved image dye densities and significantly improved image discrimination with both image-receiving elements.

Example II

Control-2 image-recording elements were prepared wherein the photosensitive element comprised a gelatin-subcoated 4 mil polyester photographic film base having coated thereon in succession the following layers:

| | |
|---|---|
| Layer 1 | |
| Gelatin | 2000 mg/m$^2$ |
| Compound A | 620 mg/m$^2$ |
| Compound B | 1500 mg/m$^2$ |
| Layer 2 | |
| Gelatin | 3000 mg/m$^2$ |
| Silver benzotriazole | 2 mmol/m$^2$ |
| Silver iodobromide | 2 mmol/m$^2$ |
| Dimezone-S | 4 mmol/m$^2$ |
| Succindialdehyde | 100 mg/m$^2$ |

Heat developable photosensitive image-recording elements (B) according to the invention were prepared wherein the photosensitive element comprised a gelatin subcoated 4 mil polyester film base having coated thereon in succession the following layers:

| | |
|---|---|
| Layer 1 | |
| Gelatin | 2000 mg/m$^2$ |
| Compound A | 620 mg/m$^2$ |
| Compound B | 1500 mg/m$^2$ |
| Layer 2 | |
| Gelatin | 1500 mg/m$^2$ |
| Silver iodobromide | 2 mmol/m$^2$ |
| Dimezone S | 4 mmol/m$^2$ |
| Layer 3 | |
| Gelatin | 1500 mg/m$^2$ |
| Silver benzotriazole | 2 mmol/m$^2$ |
| Succindialdehyde | 100 mg/m$^2$ |

Receiver elements were prepared comprising baryta paper coated with an image-receiving layer of polyvinyl chloride coated at a coverage of 12 g/m$^2$ and having coated thereon a layer comprising:

| | |
|---|---|
| Gelatin | 500 mg/m$^2$ |
| n-methylnicotinamide | 3000 mg/m$^2$ |
| succindialdehyde | 10 mg/m$^2$ |

Control-2 and image-recording elements B were prepared with the respective photosensitive elements and the image-receiving element, and the elements were exposed and processed as described in Example I. The measured values are shown in Table II.

TABLE II

| Image-Recording Element | Dmax | Dmin |
|---|---|---|
| Control-2- | 0.76 | 0.31 |
| B | 0.50 | 0.13 |

It can be seen that the image-recording element of the invention, while exhibiting substantially lower Dmax, exhibited a substantially lower Dmin. The Dmin of image-recording element B, as a percentage of the Dmax, was significantly better than that of the Control-2 element.

Example III

Image-recording element C according to the invention was prepared wherein the photosensitive element comprised a gelatin subcoated 4 mil polyester photographic film base having coated thereon in succession the following layers:

| | |
|---|---|
| Layer 1 | |
| Gelatin | 2000 mg/m$^2$ |
| Compound A | 620 mg/m$^2$ |
| Compound B | 1500 mg/m$^2$ |
| Layer 2 | |
| Gelatin | 1500 mg/m$^2$ |
| Silver iodobromide | 2 mmol/m$^2$ |
| Dimezone S | 4 mmol/m$^2$ |
| Succindialdehyde | 100 mg/m$^2$ |

An image-receiving element was prepared comprising baryta paper coated with an image-receiving layer of polyvinyl chloride coated at a coverage of 12 g/m$^2$ and having coated thereon a layer comprising:

| | |
|---|---|
| Gelatin | 500 mg/m$^2$ |
| Silver benzotriazole | 2 mmol/m$^2$ |
| n-methylnicotinamide | 3000 mg/m$^2$ |
| Succindialdehyde | 10 mg/m$^2$ |

Image-recording element C was processed as described in Example I. The processed element gave Dmax=0.50 and Dmin=0.13.

Example IV

A bichrome photothermographic image-recording element according to the invention was prepared wherein the photosensitive element comprised a gelatin, subcoated 4-mil polyester photographic film base having the following layers coated thereon in succession:

| | |
|---|---|
| Layer 1 | |
| Gelatin | 1000 mg/m$^2$ |
| Erythritol | 500 mg/m$^2$ |
| Compound C | 449 mg/m$^2$ |
| Glyoxal | 20 mg/m$^2$ |

-continued

| | | |
|---|---|---|
| Zonyl FSN | 0.1% | by wt. |
| Layer 2 | | |
| Gelatin | 750 | mg/m$^2$ |
| Erythritol | 500 | mg/m$^2$ |
| Silver iodobromide (green sensitive) | 2 | mmol/m$^2$ |
| Dimezone-S | 8 | mmol/m$^2$ |
| Glyoxal | 15 | mg/m$^2$ |
| Zonyl FSN | 0.1% | by wt. |
| Layer 3 | | |
| Gelatin | 750 | mg/m$^2$ |
| Erythritol | 500 | mg/m$^2$ |
| Silver benzotriazole | 4 | mmol/m$^2$ |
| Glyoxal | 15 | mg/m$^2$ |
| Zonyl FSN | 0.15% | by wt. |
| Alkanol XC | 0.25% | by wt. |
| Layer 4 | | |
| Gelatin | 750 | mg/m$^2$ |
| Dimezone-S | 4 | mmol/m$^2$ |
| Glyoxal | 15 | mg/m$^2$ |
| Zonyl FSN | 0.1% | by wt. |
| Layer 5 | | |
| Gelatin | 750 | mg/m$^2$ |
| Erythritol | 500 | mg/m$^2$ |
| Compound A | 0.75 | mmol/m$^2$ |
| Glyoxal | 20 | mg/m$^2$ |
| Zonyl FSN | 0.1% | by wt. |
| Layer 6 | | |
| Gelatin | 750 | mg/m$^2$ |
| Erythritol | 500 | mg/m$^2$ |
| Silver Iodobromide (blue sensitive) | 2 | mmol/m$^2$ |
| Dimezone-S | 8 | mmol/m$^2$ |
| Glyoxal | 15 | mg/m$^2$ |
| Zonyl FSN | 0.1% | by wt. |
| Layer 7 | | |
| Gelatin | 750 | mg/m$^2$ |
| Erythritol | 500 | mg/m$^2$ |
| Silver benzotriazole | 4 | mmol/m$^2$ |
| Glyoxal | 15 | mg/m$^2$ |
| Zonyl FSN | 0.15% | by wt. |
| Alkanol XC | 0.25% | by wt. |

The image-receiving element comprised baryta paper overcoated with a layer comprising 12 g/m$^2$ of polyvinyl chloride and over which there was coated a layer comprising:

| | |
|---|---|
| Gelatin | 500 mg/m$^2$ |
| m-toluamide | 750 mg/m$^2$ |
| p-hydroxyphenylmercaptotetrazole | 1 mmol/m$^2$ |
| Glyoxal | 10 mg/m$^2$ |

The image-recording element was processed as previously described at 150° C. for 60 seconds. The maximum and minimum reflection densities measured were:

| | Dmax | Dmin |
|---|---|---|
| BLUE | 1.52 | 0.35 |
| GREEN | 1.03 | 0.30 |

Although the invention has been described in detail with respect to various preferred embodiments thereof, those skilled in the art will recognize that the invention is not limited thereto but rather that variations and modifications can be made which are within the spirit of the invention and the scope of the appended claims.

What is claimed is:

1. A photothermographic image-recording element comprising a first support and an optional second support and carried by said first support or confined between said first and second supports:

an image dye-providing material layer;

a photosensitive silver halide material layer;

a silver salt oxidizing material layer;

an image-receiving material layer;

a thermal solvent and a reducing agent wherein said photosensitive silver halide material layer is arranged between said image dye-providing material layer and said silver salt oxidizing material layer, and wherein one or more of said image dye-providing material, said photosensitive silver halide material, said silver salt oxidizing material and said reducing agent is a component of a competitive chemical imaging system which provides an imagewise distribution of diffusible image dye as a result of an imagewise distribution of soluble silver ions and/or soluble silver complex during photothermographic processing of said element.

2. The photothermographic image-recording element as defined in claim 1 wherein said image-receiving layer is carried by said second support.

3. The photothermographic image-recording element as defined in claim 2 wherein said silver salt oxidizing material layer is carried by said image-receiving layer.

4. The photothermographic image-recording element as defined in claim 1 wherein said image dye-providing material is initially substantially non-diffusible but is capable of releasing a diffusible image dye material during photothermographic processing.

5. The photothermographic image-recording element as defined in claim 1 wherein said image dye-providing material is initially substantially non-diffusible but capable of undergoing cleavage during photothermographic processing to release a diffusible image dye material.

6. The photothermographic image-recording element as defined in claim 5 wherein said image dye-providing material has at least one heterocyclic ring having a 1,3 sulfur-nitrogen moiety and at least one dye radical.

7. The photothermographic image-recording element as defined in claim 6 wherein said image dye-providing material is a thiazolidine.

8. The photothermographic image-recording element as defined in claim 1 wherein said photosensitive silver halide material layer includes gelatin binder material and thermal solvent material.

9. The photothermographic image-recording element as defined in claim 1 wherein each said layer includes thermal solvent material.

10. The photothermographic image-recording element as defined in claim 1 wherein said silver salt oxidizing material layer is carried by said first support.

11. The photothermographic image-recording element as defined in claim 10 wherein said image dye-providing material layer underlies said photosensitive silver halide material layer which underlies said silver salt oxidizing material layer and wherein said image-receiving layer is carried by said second support.

12. The photothermographic image-recording element as defined in claim 1 wherein said first support carries a green-sensitive silver halide material layer arranged between a magenta image dye-providing material layer and a first silver salt oxidizing material layer, a blue-sensitive silver halide material layer arranged between a yellow image dye-providing material layer and a second silver salt oxidizing material layer and a red-sensitive silver halide material layer arranged between a cyan image dye-providing material layer and a third silver salt oxidizing material layer.

* * * * *